United States Patent [19]

Bar

[11] Patent Number: 4,523,663

[45] Date of Patent: Jun. 18, 1985

[54] SILENCER OF THE RESONANCE ABSORPTION TYPE IN MOTORCOMPRESSOR FOR REFRIGERATORS

[75] Inventor: Alfredo Bar, Pavia, Italy

[73] Assignee: Necchi S.p.A., Pavia, Italy

[21] Appl. No.: 484,287

[22] Filed: Apr. 12, 1983

[30] Foreign Application Priority Data

Apr. 15, 1982 [IT] Italy ..... 42904 A/82

[51] Int. Cl.[3] ..... F04B 21/08; F04B 39/12

[52] U.S. Cl. ..... 181/403; 415/119; 417/312

[58] Field of Search ..... 181/403, 230, 202, 240, 181/264; 415/119; 417/312

[56] References Cited

U.S. PATENT DOCUMENTS 4,457,671 7/1984 Watanabe ..... 417/312

FOREIGN PATENT DOCUMENTS 1123100 9/1956 France ..... 181/403

*Primary Examiner*—John Gonzales
*Assistant Examiner*—Brian W. Brown
*Attorney, Agent, or Firm*—Stevens, Davis, Miller & Mosher

[57] ABSTRACT

A silencer of the resonance absorption type in a motor-compressor for refrigerators in which the resonance chamber is formed by a blind cylindrical bore in the cylinder block and communicates with the refrigerant gas duct through an opening in the valve plate.

1 Claim, 3 Drawing Figures

SILENCER OF THE RESONANCE ABSORPTION TYPE IN MOTORCOMPRESSOR FOR REFRIGERATORS

DISCLOSURE OF INVENTION

The present invention relates to a silencer of the resonance absorption type in a motorcompressor for refrigerators. Silencers of this kind, already used in the art, are formed by a resonance chamber connected to the refrigerant gas duct through a pipe having a small transverse section. By means of this artifice a certain loss of charge or transmission is caused through which some gas pulse frequencies are eliminated. The transmission loss (PT) of this type of silencer, measured in decibels, can be represented on a Cartesian coordinates diagram (FIG. 3) where on the x-axis the values resulting from the ratio f/fr are written between frequency f of the noise generated by the gas in the suction duct, for example, and the frequency fr of resonance of the system, and on the y-axis an algebraic expression defining the loss of charge and containing, as terms, the volume of the resonance chamber, the section, the length and radius of the pipe connecting the duct and the resonance chamber, and the transverse section of the refrigerant gas duct. The resonance frequency is a function of the dimension of the resonance chamber and of the one pipe leading thereto.

By this silencing system an effect similar to the one obtained with a band eliminating filter in the electric field is attained, that is, a great decrease in noise in a range of frequencies contained between two resonance frequencies equal to the gas pulse frequency ($f/fr=1$).

Taking into consideration the noise caused by the gas pulsing as a sum of vibrations having different frequencies, the range of frequencies to be attenuated can be chosen by varying the dimensions of the resonance chamber and of the pipe leading to the chamber. Also, the values of the cut frequencies are functions of the dimensions of the chamber and the pipe.

An object of the present invention is a particular application of a silencer of the type described to a motorcompressor for refrigerators, which involves a reduction of the production cost and of the dimensions in comparison with similar applications already tested in this field.

The solution is characterized in that the silencer consists of a resonance chamber formed by a blind cylindrical bore formed in the cylinder block of the motorcompressor, communicating with the refrigerant gas duct through an opening drawn up in the valve plate having a transverse section smaller than the diameter of the cylindrical bore.

Other details and features of the invention will stand out from the description given below by way of nonlimitative example and with reference to the accompanying drawings, in which.

Figure 1:
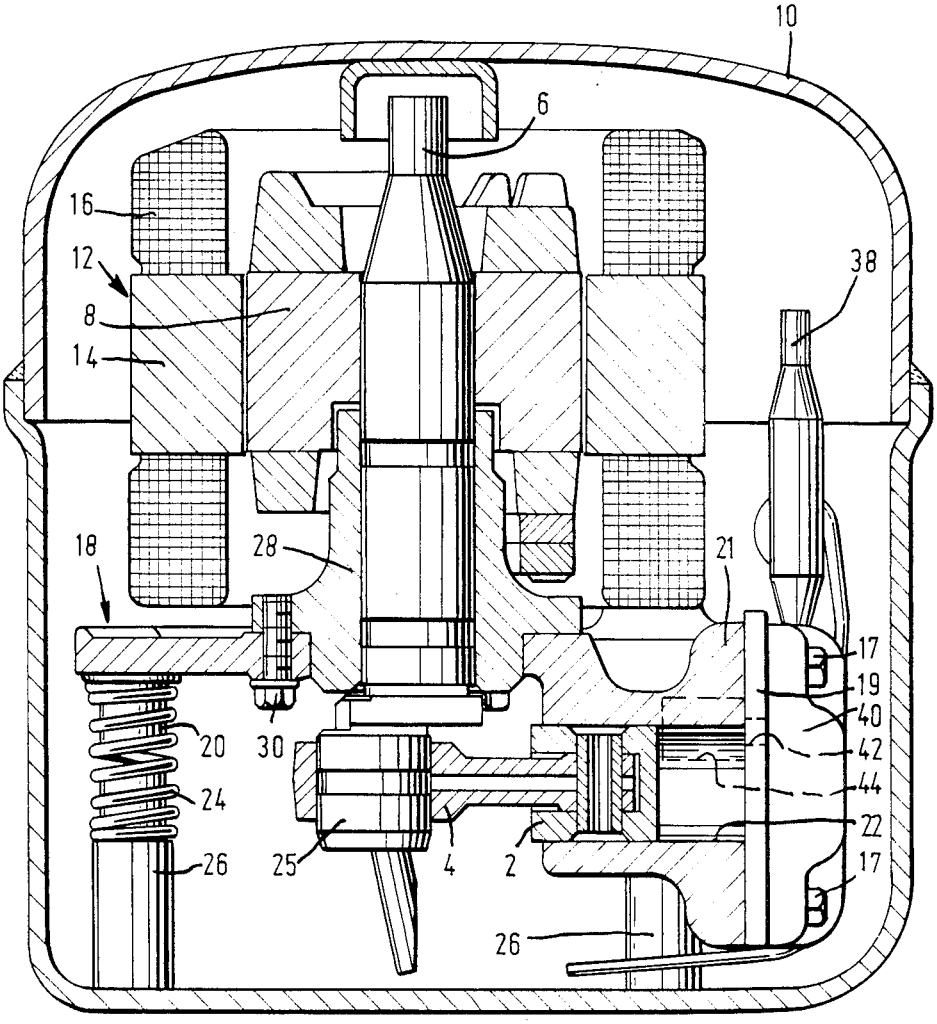
FIG. 1 shows a complete sectional view of a sealed motorcompressor.
Figure 2:
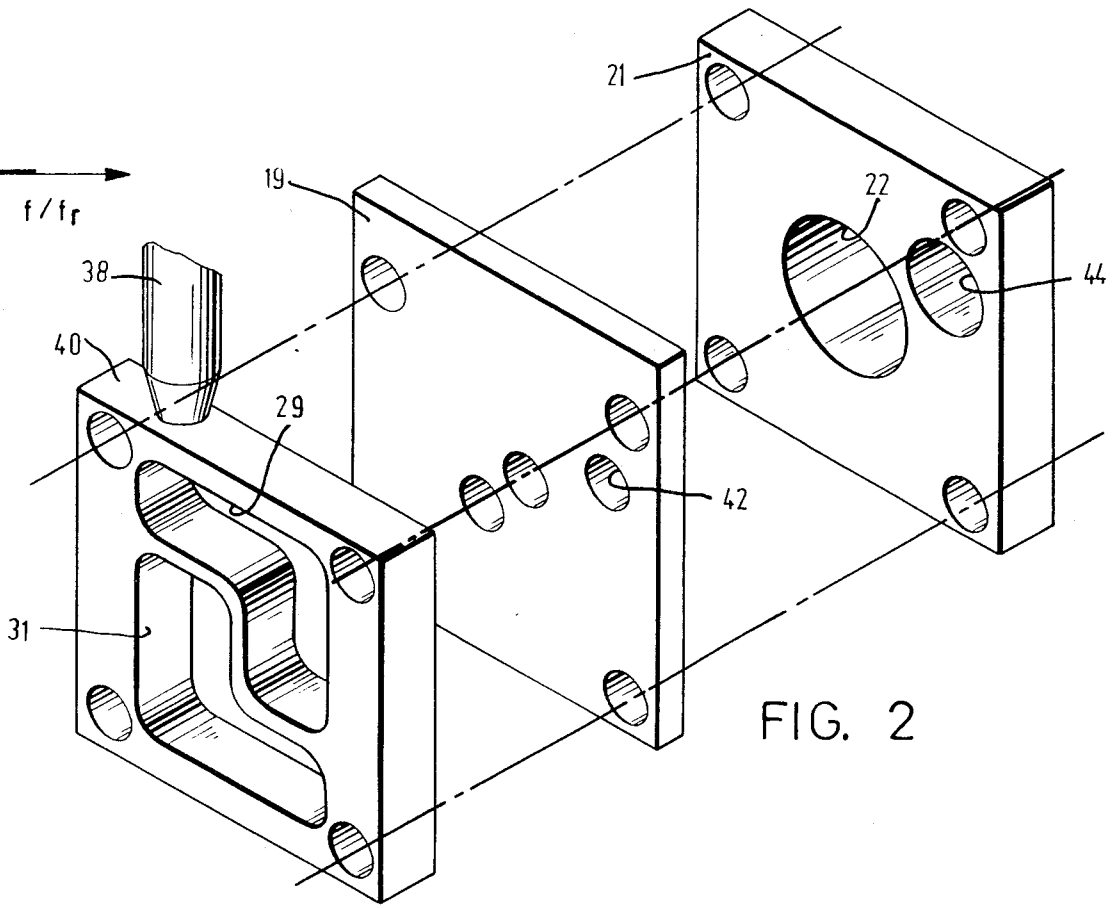
FIG. 2 shows an exploded perspective view of a member of the motorcompressor of FIG. 1.
Figure 3:
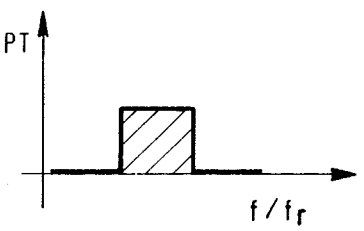
FIG. 3 is the diagram showing the transmission loss of the suctioned gas as a function of the pulsing frequency.

With reference to FIG. 1, numeral 10 indicates the sealed container inside which the motorcompressor 12 is placed. This one is formed by stator 14, windings 16, rotor 8 fixed to the main shaft 6 supported by a bush 28, fixed to the body 18 of the motorcompressor 12 by means of screws 30.

The body 18 is suitably supported on columns 26 by interposing a helical spring 24. Molded into body 18 of the motorcompressor is cylinder 22, inside of which piston 2 is slidingly connected to crank 25 of shaft 6 by means of connecting rod 4. The cylinder 22 is closed by valve plate 19 and head 40, which are fixed by means of screws 17 to the front wall of portion 21 of body 18. Inside head 40 are suction chamber 29 and delivery chamber 31.

Refrigerant gas dissipated inside shell 10 is sucked into chamber 29 through tube 38, communicating with the suction chamber 29.

According to the invention, in the valve plate 19 an opening 42 communicates on one side of valve plate 19 with the suction chamber 29 in the head 40 and on the other with a blind cylindrical bore 44 extending horizontally, for a certain length, into the portion 21 containing cylinder 22.

Opening 42 in the valve plate 19 and cylindrical bore 44 having a diameter larger than the transverse dimension of said opening 42 make a silencer of the resonance chamber type whose effect already has been shown in the introduction part of the disclosure.

The silencer does not require the use of other members and supplemental space to locate them. Its production cost is limited and its working effectiveness remarkable.

I claim:

1. Resonance absorption type silencer in a motorcompressor unit for refrigerators, comprising a cylindrical block of said motorcompressor unit defining a blind cylindrical bore, a valve plate of said unit defining an opening therethrough and fitting against said cylindrical block and a cylinder head of said unit fitting against said valve plate and defining a chamber therein communicating with the interior of said unit and said bore and opening, said opening having a transverse dimension smaller than the diameter of said bore.

* * * * *